United States Patent [19]

Klefbeck

[11] Patent Number: 4,562,983

[45] Date of Patent: Jan. 7, 1986

[54] BAG HOLDERS

[76] Inventor: Robert J. Klefbeck, 3 Dresden Ct., Albany, N.Y. 12203

[21] Appl. No.: 151,965

[22] Filed: Jul. 23, 1980

[51] Int. Cl.[4] ..... A63B 55/04

[52] U.S. Cl. ..... 248/97

[58] Field of Search ..... 248/94, 95, 97, 99, 248/150, 168, 188.5, 464, 465, 439

[56] References Cited

U.S. PATENT DOCUMENTS

| | | | |
|---|---|---|---|
| 128,073 | 6/1872 | Roseborough | 248/97 |
| 151,679 | 6/1874 | Benson . | |
| 478,913 | 7/1892 | Bratney | 248/99 |
| 561,857 | 6/1896 | Baxter | 248/439 |
| 563,496 | 7/1896 | Macklin | 248/188.5 |
| 1,007,322 | 10/1911 | Barnes | 248/188.5 |
| 1,269,901 | 6/1918 | Burke | 248/97 X |
| 1,304,405 | 5/1919 | Tate | 248/94 X |
| 1,966,512 | 7/1934 | Misner | 248/362 |
| 2,229,475 | 1/1941 | Redmer | 248/185.5 |
| 2,812,614 | 11/1957 | Ladyman | 248/362 X |
| 3,201,080 | 8/1965 | Rose | 248/188.5 X |
| 3,627,242 | 12/1971 | Vandermast | 248/97 |
| 3,958,785 | 5/1976 | Aboud | 248/150 X |
| 4,157,801 | 6/1979 | Elmer | 248/97 |

FOREIGN PATENT DOCUMENTS

| | | | |
|---|---|---|---|
| 559559 | 9/1932 | Fed. Rep. of Germany | 248/150 |

*Primary Examiner*—Reinaldo P. Machado
*Assistant Examiner*—Alvin Chin-Shue
*Attorney, Agent, or Firm*—Heslin & Watts

[57] ABSTRACT

A device for maintaining a flexible trash bag in an opened mouthed and vertical receiving position regardless of terrain having three legs which are adjustable in length to accommodate lands of pitching characteristics. The legs being of a plastic tubular design adapted to telescopically collapse to the approximate dimensions of a frame and lock at the plane of the frame by means of a locking ring to achieve minimum storage space. Removable suction leg tips are provided for indoor use.

1 Claim, 4 Drawing Figures

Fig. 2
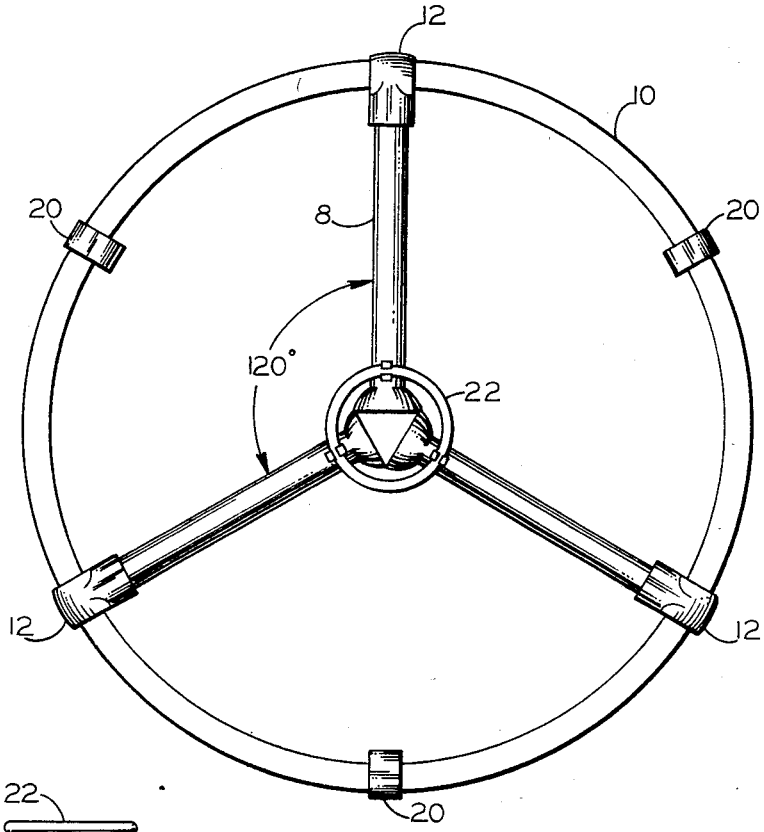
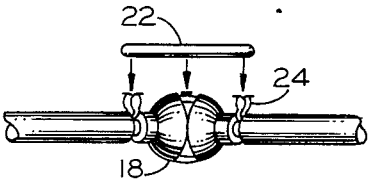
Fig. 3
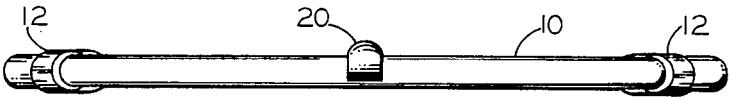
Fig. 4

BAG HOLDERS

BACKGROUND OF THE INVENTION

The present invention relates to an apparatus designed for holding trash bags in an open and extended position and, when not in use, can be stored in a collapsed and compact position. Several trash bag supports have been devised that are capable of supporting lightweight disposable garbage bags. However, none are available that adapt readily to variable terrains while also providing for compact storage when collapsed and not in use. One type of trash bag holder has been devised whereby rigid support is given for the bag but no consideration for collapsibility or storage compactness is provided. Storage of these devices when empty and not in use requires the same amount of space as when they are in use. In order to minimize the storage space required for this type of bag holder, a complete disassembly of each unit is necessary. A second type of bag holder has been described that collapses for storage but remains quite bulky in the collapsed position and contains extending protrusions that severely limit its storage capabilities. Furthermore, these holders are mounted on legs that have limited flexibility for adapting to variations in the terrain.

The advantages of the present invention are threefold. First, the legs are mounted on a frame in such a manner that when in a fully retracted state, they can be rotated to the center of the frame and completely maintained within the plane of the frame member. The collapsed holder of this invention contains no overlapping or protruding parts that would interfere with compact storage. Second, the trash bag holder is designed with telescipocally adjustable legs that allow for the holder to be adjusted to varying heights in order to accommodate use on unlevel ground. Third, the legs are provided with suction cups that provide stability for indoor use.

SUMMARY OF THE INVENTION

It is a major objective of the present invention to provide a collapsible trash bag holder which utilizes legs that telescope so as to facilitate the stable use of the trash bag holder out of doors and on unlevel terrain.

A second major objective is to mount the telescopic legs in such a manner so as to provide for compact folding and subsequent storage of the bag holder.

Generally, the objectives of this invention are carried out by providing a frame member for holding the open mouth of a trash bag above the ground. A plurality of legs are attached to the frame member in such a manner as to move freely through a series of angular support positions. The legs are adjustable in length between an advanced and retracted position in order to maintain the mouth of the bag at preselected heights above the ground. When the trash bag holder is not in use, the legs rotate inwardly towards the center of the frame and lie completely within the plane of the frame member. The thickness of the plane frame is substantially equal to the thickness of the single leg. The thickness of the plane of the frame should not exceed the leg thickness or as an alternate embodiment, the leg thickness should not exceed the thickness of the plane of the frame. Each leg contains a clamp adapted to align with each other when the legs are retracted and in their folded position. A locking member is provided to engage each clamp, whereby all the legs are interconnected and held together when in a collapsed position.

BRIEF DESCRIPTION OF THE DRAWINGS

FIG. 2 is a top plan view with the legs completely retracted, collapsed and engaged in the locking means.

FIG. 3 is an enlarged side elevation of the central portion of the invention in its collapsed state, showing the locking means in greater detail.

FIG. 4 is a side elevation of the entire invention in its collapsed state.

DETAILED DESCRIPTION OF THE INVENTION

Figure 1:
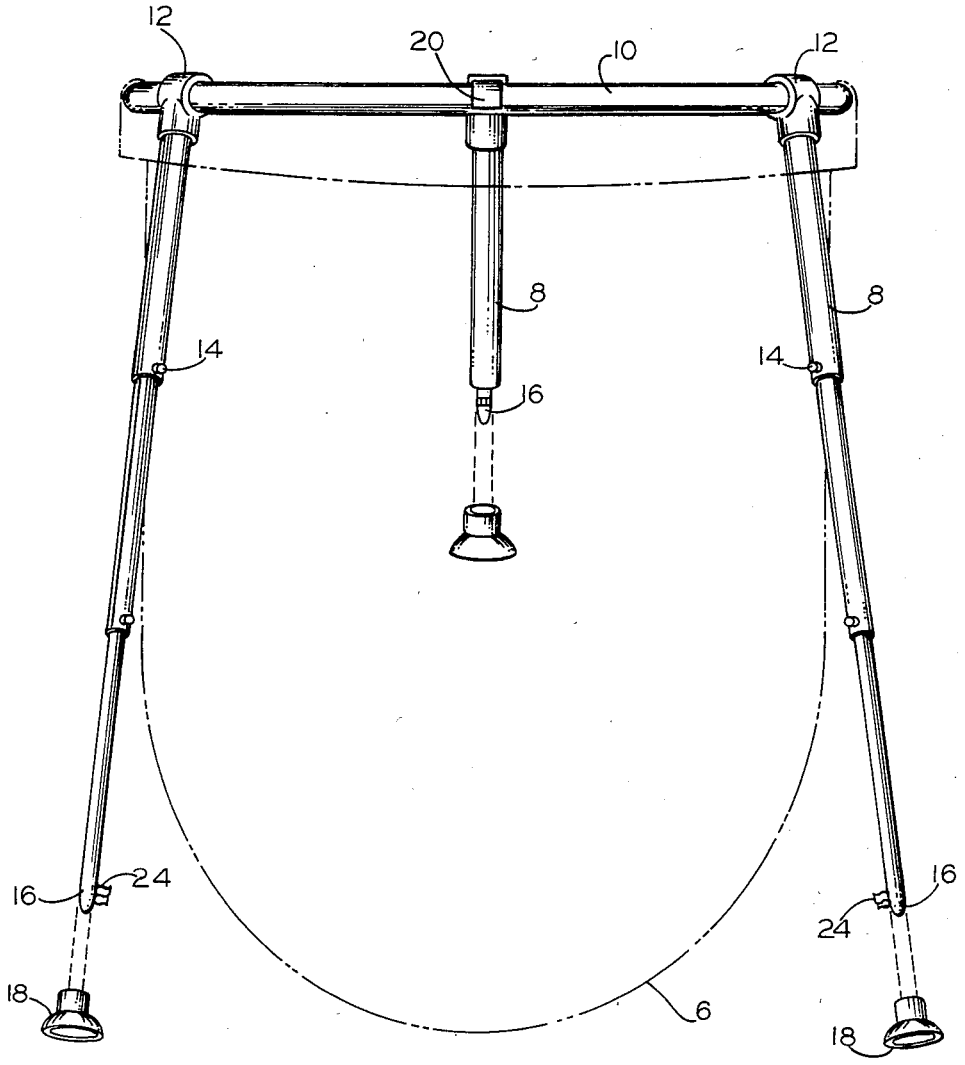
FIG. 1 is an elevation of the invention with two legs fully advanced and one leg completely retracted.

In reference to FIG. 1, the side view of the trash bag holder is shown with two legs 8 in an advanced position and one leg 8 in a retracted and unfolded position. Trash bag 6 is shown in phantom in an open and extended position whereby the open end folds over frame member 10. Radial pivotal hinges 12 or any other means that will permit separate angular adjustment for each leg 8 by simple rotation about frame member 10 may be used for connecting legs 8 to frame member 10. Legs 8 are designed to telescopically extend and retract to facilitate the positioning of the bag holder on unlevel terrain. Telescopic control of legs 8 is maintained by positioning push button spring locks 14 along telescopic segments of legs 8. The use of three such telescopic segments for each leg 8 and two spring locks 14 has been found to be useful, but other variations in the number of leg segments and spring locks may be more advantageous depending on the trash bag size. Distal end 16 of each leg may be pointed so as to stabilize the trash bag holder when used out of doors. When indoor use of the trash bag holder is desired, placement of suction cups 18 on distal end 16 of legs 8 is recommended. Legs 8 and frame 10 are generally constructed of lightweight plastic tubular material although other material such as aluminum may be used.

FIG. 2 is a plan view of the trash bag holder in a collapsed position ready for storage when not being used. Legs 8 are in their fully retracted position and folded in toward the center of frame member 10. The preferred configuration of frame member 10 is that of a circle with the placement of three legs equidistant therearound, each separated by 120°. It is not intended, however, to limit the trash bag holder to a circular configuration with three legs, for it is conceivable that other configurations with a varying number of legs may be used. An attachment means 20 for securing the open end of trash bag 6 is shown as a series of three plastic clamps. It should be noted, however, that various types and numbers of clamping devices may be used. Locking member 22 is adapted to engage each leg clamp 24 (see FIG. 3) when the trash bag holder is in the collapsed position. The shape of locking member 22 is necessarily dictated by the configuration of frame member 10, both are shown in FIG. 2 as being circular. FIG. 4 demonstrates the unique compact storage feature of this invention. When in the completely collapsed and locked position of FIG. 2 and FIG. 4, the entire unit radius and thickness is no greater than that of frame member 10 or legs 8. It is understood that changes and modifications in the specifically described embodiment can be carried out without departing from the scope of the invention which is intended to be limited only by the scope of the appended claims.

What is claimed is:

1. A collapsible trash bag holder which comprises:

a frame member for holding the mouth of a trash bag in an open position, said frame member defining a substantially enclosed plane of predetermined thickness;

a plurality of legs for supporting the frame member during use of the bag holder, said legs being adjustable in length between an advanced and a retracted position;

means connecting an end of each leg to the frame member for pivoting each leg between a support position for supporting the frame member during use of the bag holder and a collapsed position for storage in which position the legs lie in a substantially common plane with each other within the boundary of the frame member, said common plane having a thickness substantially equal to the thickness of a single leg, the thickness of the frame plane not exceeding the leg thickness;

a plurality of clamps, one for each leg, adapted to align with each other when the legs are in their collapsed position; and a locking member adapted to engage each clamp, whereby all the legs are interconnected and locked together in their collapsed position.

* * * * *